United States Patent [19]

Kuchenbecker

[11] 4,362,245

[45] Dec. 7, 1982

[54] LIQUID TIGHT POURING CARTON

[75] Inventor: Morris W. Kuchenbecker, Neenah, Wis.

[73] Assignee: American Can Company, Greenwich, Conn.

[21] Appl. No.: 131,755

[22] Filed: Mar. 19, 1980

Related U.S. Application Data

[63] Continuation-in-part of Ser. No. 101,713, Dec. 10, 1979.

[51] Int. Cl.[3] ..... B65J 5/74

[52] U.S. Cl. ..... 206/621; 206/628; 229/17 R

[58] Field of Search ..... 229/7 R, 17 R, 17 G, 229/3.5 MF, 3.1, 37 R, 37 E, 38, 39, 8; 206/605, 608, 611, 620–622, 626, 628

[56] References Cited

U.S. PATENT DOCUMENTS

| | | | |
|---|---|---|---|
| 2,321,139 | 6/1943 | Gruger | 229/37 R |
| 2,474,476 | 6/1949 | Guyer | 229/37 R |
| 3,232,514 | 2/1966 | Swede et al. | 229/17 R |
| 3,333,758 | 8/1967 | Buchner | 229/17 R |
| 3,471,991 | 10/1969 | Rausing . | |
| 3,795,359 | 3/1974 | Rausing | 229/17 R X |
| 3,892,347 | 7/1975 | Egleston | 229/17 R |
| 4,078,715 | 3/1978 | Larsson et al. | 229/17 R |
| 4,248,351 | 2/1981 | Berg | 229/17 R |

FOREIGN PATENT DOCUMENTS

| | | | |
|---|---|---|---|
| 1296084 | 5/1969 | Fed. Rep. of Germany | 229/7 R |
| 2515849 | 10/1975 | Fed. Rep. of Germany | 229/17 R |
| 1247747 | 10/1960 | France | 229/17 R |
| 186983 | 10/1936 | Switzerland | 229/17 R |
| 861079 | 2/1961 | United Kingdom | 229/7 S |
| 1046424 | 10/1966 | United Kingdom | 229/17 R |

*Primary Examiner*—Stephen Marcus

*Attorney, Agent, or Firm*—Robert P. Auber; Stuart S. Bowie; Thomas D. Wilhelm

[57] ABSTRACT

A liquid tight pouring carton is provided, having a pour spout which is easily opened by removal of a tear tab, and can be fully extended thereafter. The tear tab is provided as part of a sealed fin on the top of the carton; the tear tab having a line of weakness extending through the paperboard, but not into or through the barrier and sealing layers of foil and plastic. Until the tab is removed, the carton is completely sealed to leakage or contamination. Additional features provide for reliable and easy opening of the carton.

The invention also contemplates a blank suitable for erection into the carton, and a method of making the blank and erecting and sealing it.

24 Claims, 14 Drawing Figures

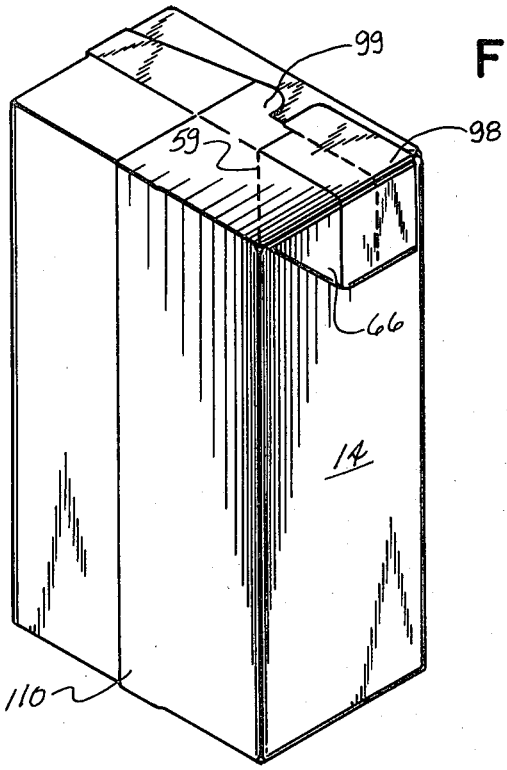
FIG.4
FIG.5
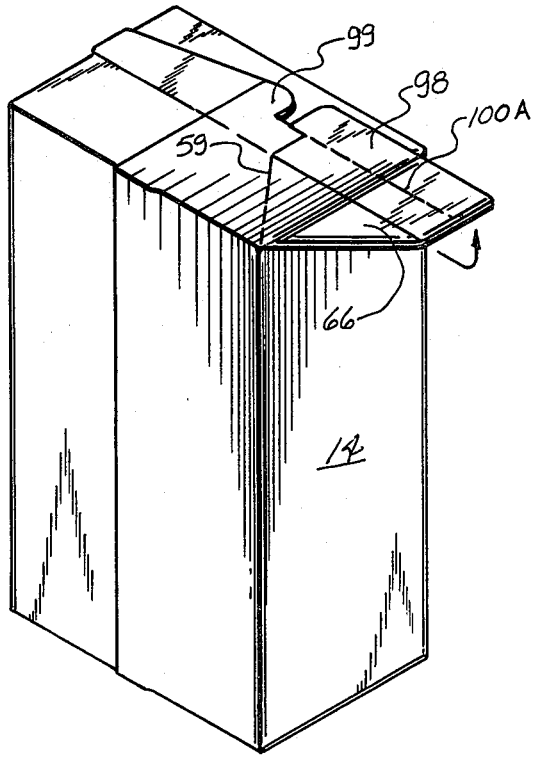
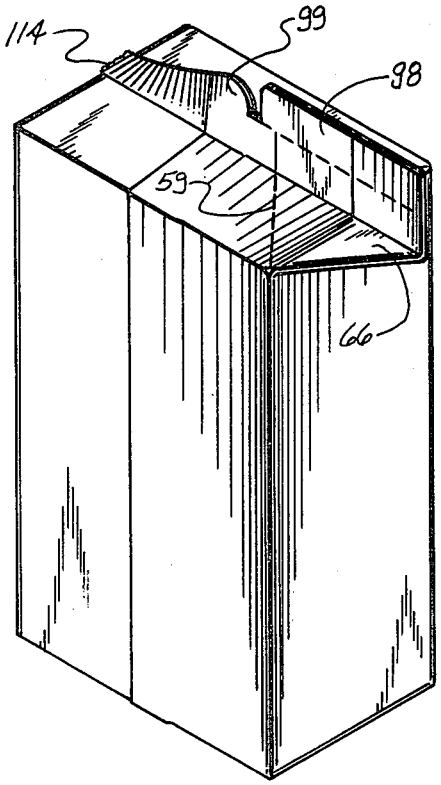
FIG.6

FIG.12
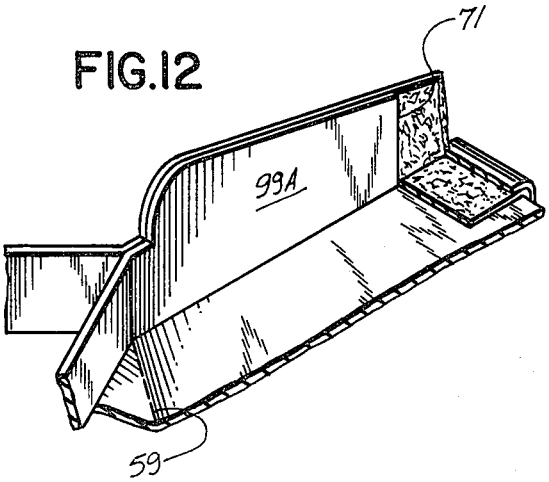
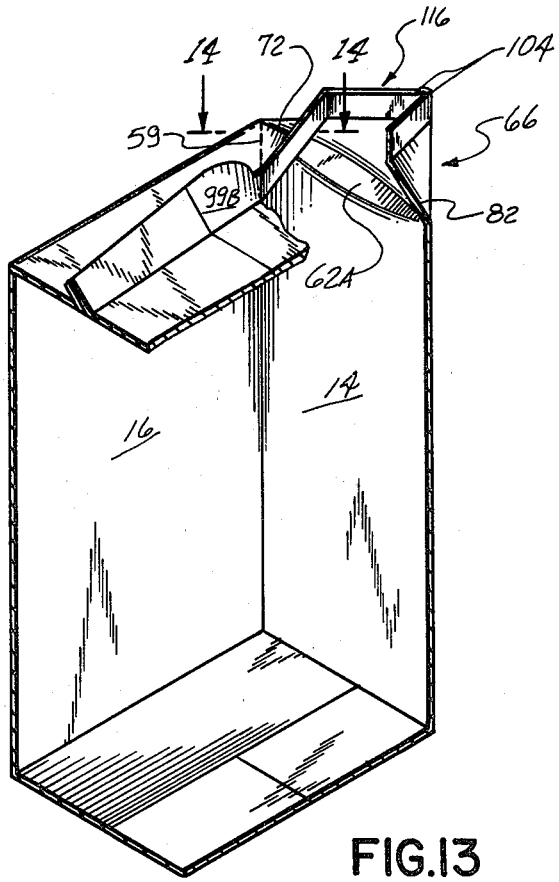
FIG.13
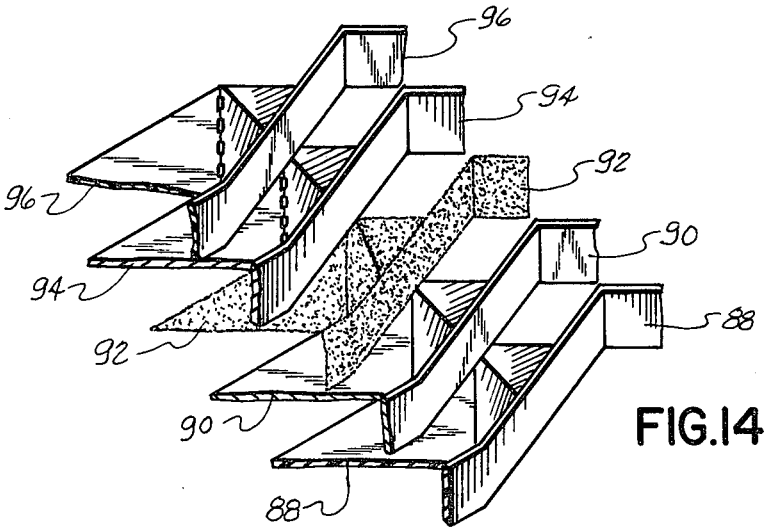
FIG.14

LIQUID TIGHT POURING CARTON

This is a continuation-in-part of prior application Ser. No. 101,713, filed Dec. 10, 1979, for LIQUID TIGHT POURING CARTON, by Morris W. Kuchenbecker.

BACKGROUND OF THE INVENTION

This invention pertains to the technology of cartons generally formed of paperboard and capable of holding liquid products. Typical cartons have a core structural layer of paperboard providing the carton's strength and rigidity. A layer of aluminum foil is adhered to one surface of the paperboard and serves as a barrier layer against passage of contaminants into the package. Both outer surfaces of the paperboard/foil combination are then coated with heat sealable plastic. While a number of specific constructions are known, it is generally accepted practice to close the carton openings with seals wherein surfaces of the plastic which faces the interior of the carton are brought into face-to-face contact along opposing edges and sealed together, in most cases forming a fin. A typical carton is produced as Systempak, by Papeteries de Belgique in Belgium. A similar carton is produced by Tetra-Pak in Lund, Sweden. German Pat. No. 2,721,390 describes another similar carton wherein part of the paperboard is removed from one side of a longitudinal seam to reduce the possibility of product leakage from the carton bottom. This and similar cartons are believed to be produced by Jagenberg Werke AG, Dusseldorf, Germany. U.S. Pat. No. 3,998,378, assigned to Jagenberg Werke AG, teaches a specific configuration for the bottom construction. U.S. Pat. No. 4,185,765, teaches a specific seal and score line configuration in the top fin for opening the carton.

In cartons of the prior art known to the inventor, access to the product is obtained by cutting open the fin seal on the top of the carton and cutting away a portion of the spout. Most of the above-mentioned cartons suggest the use of scissors. One observed prior art sample had a line of dashed cut scores extending part way through (but not completely through) the paperboard layer along the base of the top fin. A cutting device was essential to opening the carton along that line.

While the use of a cutting device such as scissors is certainly functional, it is inconvenient, and it is not always practical to have a cutting device available. Further, in cutting away part of the spout, the functional utility of the spout is somewhat impaired.

Thus, the use of existing cartons is limited by the immediate availability of some means of cutting open the carton, and the utility of the opened carton in dispensing product is somewhat impaired by the opening process.

It is therefore an object of this invention to provide a liquid-tight pouring carton which can be opened without the use of a mechanical cutting device.

It is a further object of this invention to provide such a carton having a complete spout, which maximizes the functional utility of the spout, and thus the ease of pouring.

It is a particular object to provide an opening means which can be activated to open the carton by tearing the opening means on a predetermined and weakened line, the carton being fully sealed and capable of holding liquid until the opening means is activated.

Also contemplated is a blank suitable for erection into the liquid-tight carton of this invention.

A particular object is to provide a method of making the blank, and subsequently forming it into the carton.

SUMMARY OF THE INVENTION

It has now been found that certain of the foregoing and related objects of the invention are readily attained in a novel liquid tight carton, and a carton blank, constructed from a structural carton material, and having a heat sealable layer on the inner surface thereof. The structural carton material and the heat sealable layer comprise the material structure of the carton. The carton comprises a bottom wall, upstanding side walls and upstanding end walls, the side walls and end walls connected to the edges of the bottom wall and to each other to form a receptacle; and a top wall connected to the side walls and the end walls. The top wall is comprised of extensions of the side walls and the end walls, the extensions being joined together and comprising main extension panels joined to the side walls and the end walls, and sealing margins on the edge of each extension remote from the side walls and the end walls, the sealing margins being joined together in the form of a fin seal, producing a fin having multiple thicknesses of the carton material structure joined together on the top of the carton. The seal has an outer edge disposed toward the outer edge of the fin and an inner edge disposed toward the interior of the carton. The carton and fin both have a corresponding and specific end identified for disposition of opening means thereon. Each thickness of structural carton material has a structural line of weakness substantially on the inner edge of the seal and extending along the fin from substantially the one end thereof to a point short of the other end of the fin, the structural lines of weakness being disposed within the structural carton material. Thus, the heat sealable layer is devoid of the structural lines of weakness and serves as an effective barrier against leakage of product which may be contained in the carton. The structural lines of weakness on opposing thicknesses of carton material structure are in substantial registry with one another, forming an easily removable section of the top wall.

In a preferred embodiment, the margins comprising the fin have an opening tab extension connected thereto on the one end of the fin, the structural line of weakness on each thickness of carton material structure being disposed between the opening tab extension and the corresponding one of the margins, the opening tab extension being joined together, and comprising an easily removable section of the top wall. The sealing margins disposed generally between the opening tab and the interior of the carton, on the one end of the fin, are substantially free of seals between one another. The top of the carton has a substantially continuous seal along the entire length thereof, the seal extending continuously from the opening tab onto the sealing margin spaced away from the tab and the one end of the fin.

An especially preferred embodiment includes a layer of metal foil interposed between, and adherent to, the structural carton material and the heat sealable layer, the metal foil and the heat sealable layer comprising an inner lining in the carton, the lining being devoid of the structural lines of weakness, and comprising a portion of the carton material structure.

While the structural lines of weakness may have a variety of constructions, the preferred construction comprises a substantially continuous cut line through the structural carton material, the lining being unbroken and unweakened in the area of the cut line.

In a most preferred embodiment, the carton is adapted for pouring a liquid, and the top wall has a pour spout on the end thereof corresponding to the one end of the carton, the pour spout being comprised of a series of gussets. The combination of the pour spout and the removable section is cooperatively disposed so that, upon removal of the removable section, the spout may be opened for dispensing product. The pour spout may include a foldable line extending from the pouring tip of the pour spout downwardly through the center of the corresponding extension and onto the corresponding end wall. In an especially preferred embodiment of the spout construction, the structural lines of weakness include a small, uncut, and substantially unweakened, segment of carton material at the one end of the fin where the pouring tip is to be formed when the carton is opened, such that, when the easily removable section is removed, allowing the carton to be opened, the tearing away of the unweakened segment leaves a ragged tit on the tip of the pouring spout.

In an advantageous assembly of the carton, the fin is folded against the top wall and the ends of the top wall are folded down against the corresponding end walls and secured to them.

In order for the carton to be most advantageously opened, at least one sealing margin may have a line of weakness extending from the outer edge of the margin to the one edge of the main extension panels, the line of weakness being located adjacent the joinder between the end wall extension opposite the one end of the carton and the adjoining side wall extensions, and between that joinder and the one end of the carton. This provides for relief of the stresses imposed on the fin when the fin is erected for carton opening.

In order for the pouring spout to be most advantageously erected and opened, the top wall is joined to the corresponding end wall on the designated one end of the carton by an intermediate panel defined by a pair of arcuate score lines extending from one side wall to another side wall. Resistance to spout opening is diminished by having, on the one end of the carton, lines of perforation on the extension panels and extending diagonally across the panels from substantially the joinder of the side walls and the corresponding end wall to generally the point short of the other end of the fin. Additionally, fin erecting tabs may be disposed on the margins between the opening tab and the other end of the fin.

The invention further contemplates a method of forming the carton of this invention, the method including, in order, the steps of forming the specified lines of weakness and lines of perforations on the structural carton material; adhering a heat sealable layer of liquid-impervious material to the predetermined inner surface of the structural carton material, and over the formed lines of weakness and perforations; scoring the composite carton material structure, and cutting the carton blank from the sheet; and erecting, folding and sealing the carton. The method also contemplates the heat sealable layer being adhered to the entire inner surface of the structural carton material. Preferrably, the heat sealable layer is extrusion coated onto the structural carton material.

In an especially preferred method, the steps include forming the specified lines of weakness and lines of perforations, and substantially simultaneously printing the material on its outer surface; laminating a sheet of metal foil to the inner surface of the carton material, and extrusion coating a plastic onto the outer paperboard surface and the exposed inner surface of the foil, the extrusion coating on the inner surface of the foil being of a thickness effective for heat sealing the carton members to each other in face-to-face seals between coated inner surfaces; scoring the composite carton material structure and cutting the carton blank from the sheet; and erecting, folding and sealing the carton.

The preferred method of folding and sealing the carton comprises the steps of forming a fin seal on the top of the carton, folding the fin against the top wall, and folding down and securing the ends of the top wall against the corresponding end walls.

BRIEF DESCRIPTION OF THE DRAWINGS

FIG. 4 is a perspective view of the erected and closed carton.

FIG. 5 is a perspective view of the carton with the end of the spout and the opening tab partially erected for opening.

FIG. 6 is a perspective view of the carton with the spout and opening tab fully erected and ready for opening.

FIG. 12 is an enlarged fragment of the top fin taken at 12—12 in FIG. 9 showing the fin delamination resulting on fin erection.

FIG. 13 is a cut away perspective taken at 13—13 in FIG. 8, and showing the relationships with the intermediate panel.

FIG. 14 is an enlarged exploded fragment taken at 14—14 of FIG. 13, and showing the perforations in the several layers.

DETAILED DESCRIPTION OF THE PREFERRED EMBODIMENTS

Figure 1:
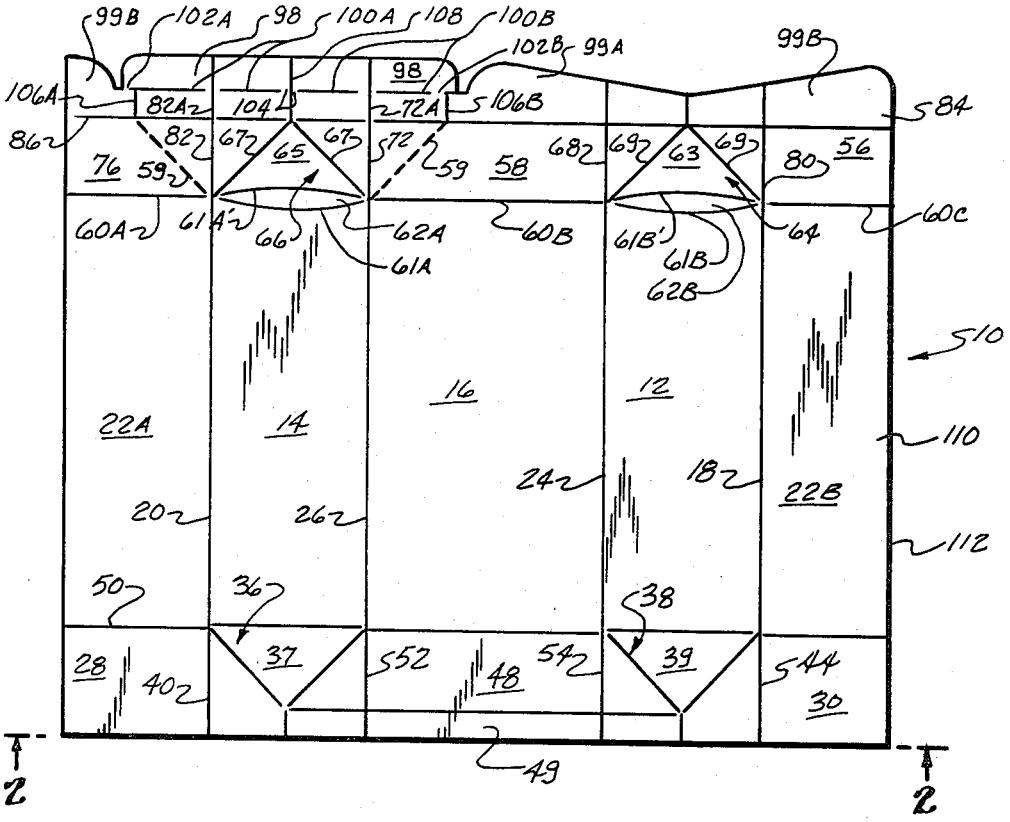
FIG. 1 is a plan view of a blank for making the package of this invention.
Figure 2:
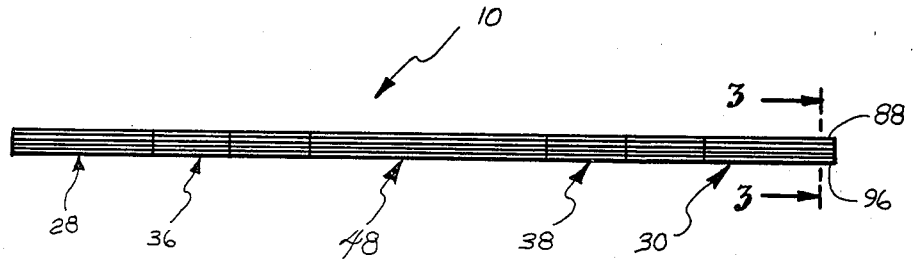
FIG. 2 is an edge view of the blank of FIG. 1, showing the layers responsible for the package function.
Figure 3:
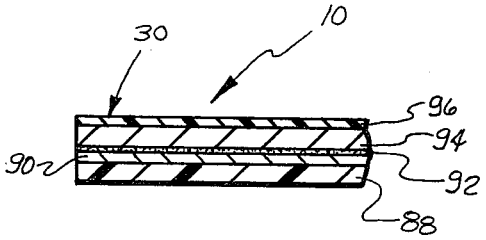
FIG. 3 is an enlarged fragment of the edge view taken at 3—3 of FIG. 2, and showing, in detail, all the layers in the composite structure of the blank material, in reverse order.

A liquid-tight pouring carton is formed from a flat blank such as that shown in FIG. 1 and generally designated as 10. As shown in FIG. 2, the blank is generally a five layer structure including paperboard, aluminum foil, and heat sealable plastic. Paperboard provides the general structural strength and rigidity, and serves as the structural carton material. Aluminum foil serves as a barrier protecting the contents from contamination by the external environment. The heat sealable plastic forms a continuous seal in the formed carton to effectively contain liquid product. As shown in greater detail in FIG. 3, the blank is composed, from the inside layer toward the outside of a heat sealable plastic 88 adhered to a layer of aluminum foil 90 which is adhesively mounted on its opposing surface, by means of adhesive 92 to paperboard 94. The paperboard is coated on its outside surface by a layer of polyethylene 96. Now reviewing the structure and its manufacture in detail—the blank has two end walls 12 and 14, and a side wall 16 interposed between end walls 12 and 14 and connected therebetween by hinge lines 24 and 26. Side wall panels 22A and 22B are connected to the opposite sides of end walls 12 and 14 respectively by hinge lines 18 and 20.

Bottom wall panels 28, 30, 36, 38, and 48 are extensions of side wall panels 22A and 22B and end and side walls 12, 14, and 16, and are connected thereto by hinge line 50. Bottom wall panels 36 and 38 include triangular panels 37 and 39 respectively and sealing margins. Panel 36 is connected to panel 28 by hinge line 40. Panel 38 is connected to panel 30 by hinge line 44. Panel 48 has a sealing margin 49, which extends onto panels 36 and 38, and is connected to panel 36 by hinge line 52 and to panel 38 by hinge line 54.

Top wall panels 56, 58, 64, 66, and 76 are extensions of side wall panels 22A and 22B, and end and side walls 12, 14 and 16. Panels 76, 58, and 56 are connected to panels 22A, 16 and 22B respectively by hinge lines 60A, 60B, and 60C. Panels 64 and 66 are connected to end wall panels 12 and 14 through intermediate panels 62B and 62A. Panel 62A is defined by arcuate score lines 61A and 61A'. Panel 62B is defined by arcuate score lines 61B and 61B'. Top wall panels 64 and 66 include triangular panels 63 and 65. Panel 64 is connected to panel 56 by hinge line 80. Panel 66 is connected to panel 76 by hinge line 82. Top wall panel 58 is connected to panel 64 by hinge line 68 and to panel 66 by hinge line 72. Hinge lines 72A and 82A, which are part of lines 72 and 82 respectively, extend from hinge line 86 to cut lines 100B and 100A respectively. Panels 56, 58, 64, 66 and 76 have included therein a sealing margin 84 bounded generally by crease line 86 and extending toward the outer edge of the blank. Panels 58 and 76 have hinge lines 59 extending diagonally thereacross from crease line 86 to hinge lines 60B and 60A respectively. Lines 59 are perforated into and through paperboard layer 94, as shown in FIG. 14. The perforations may also extend through polyethylene layer 96. In some embodiments the perforations also extend through polyethylene layer 96.

Cut score line 71, as best seen in FIG. 12, extends from the outer edge of the blank toward hinge line 86. The foil 90 and heat seal plastic 88 are not perforated, or cut scored, thus preserving the integrity of the barrier and seal layers.

Sealing margin 84 has appended thereto an opening tab extension 98, appended onto that portion of the sealing margin comprising panels 58, 66, and 76. It is intended that opening tab extension 98 be considered distinct from sealing margin 84 wherever it is used; and the opening tab extension will hereinafter be referred to as an opening tab.

Sealing margin 84 also has appended thereto spout erecting tabs 99A and 99B, appended onto most of the remainder of the outer edge of the sealing margin. It is intended that spout erecting tabs 99A and 99B be considered part of sealing margin 84 wherever they are used; and the spout erecting tabs will hereinafter be referred to as erecting tabs.

Cut lines 100A and 100B extend across the sealing margin 84 generally forming the boundary between tab 98 and the sealing margin. Significantly, cut lines 100A and 100B extend through the paperboard layer 94, but do not extend into or through the metal foil and heat sealing layers 90 and 88. Thus the barrier and sealing properties provided by layers 90 and 88 are preserved in the area of cuts 100A and 100B. The cuts may or may not extend through layer 96, depending on the method of construction, as hereinafter described. Small reinforcing nicks 102A and 102B in cut lines 100A and 100B provide sufficient structural strength to prevent inadvertent initiation of tearing along lines 100A and 100B and removal of tab 98. Between the facing ends of cut lines 100A and 100B is an uncut area 104. In a typical one liter carton, the uncut distance between the ends of lines 100A and 100B is about 6 millimeters. Hinge lines 106A and 106B extend from the intersection of lines 59 and 86 across sealing margin 84 to nicks 102A and 102B respectively. Hinge line 108 extends from the intersection of hinge lines 67 and 86 across sealing margin 84 and opening tab 98 to the outer edge of the blank.

In the preferred method of making the blank, a roll of paperboard is first die cut, making perforations 59, cut score 71, and cut lines 100A and 100B. If desired, the paperboard may be printed in the same operation. A layer of aluminum foil is then extrusion laminated to the surface of the paperboard which will face the interior of the carton. Typically, the foil is 0.00030 to 0.00035 inches thick, and the laminant is polyethylene. At this point, the composite structure includes the paperboard 94 and the foil 90 on its outer surfaces and laminant 92 between layers 90 and 94, as the adhesive. The foil surface is then extrusion coated with the heat sealable layer 88, and the paperboard surface is extrusion coated with polyethylene. In the final step of making the blank, the remainder of the lines are formed by crease scores and the blank is cut from the continuous roll.

EXAMPLE 1

Paperboard having a weight of 150 pounds per 3000 square foot feam and 13 mils thickness in roll form was unwound, printed, and cut, forming lines 100A and 100B, perforation lines 59, and cut score 71, and wound up. Aluminum foil 0.00035 inch thick was then extrusion laminated to the surface of the paperboard predetermined to be on the inside of the carton using $\frac{3}{4}$ mil of low density polyethylene and the composite structure was wound up. The foil surface was then extrusion coated with $2\frac{1}{4}$ mils of Surlyn, an ionomer sold by the duPont Company. The paperboard surface was then extrusion coated with $\frac{3}{4}$ mil of low density polyethylene. Finally, the crease scores were formed and the finished blanks were cut from the roll.

EXAMPLE 2

In an alternate method, the surface of the paperboard predetermined to be on the outside of the carton was first extrusion coated with $\frac{3}{4}$ mil low density polyethylene. It was then printed and cut, forming lines 100A and 100B, perforation lines 59, and cut score 71. Cut lines 100A and 100B and perforations on lines 59 penetrated both the paperboard and the polyethylene. The aluminum foil was then extrusion laminated to the inside surface of the paperboard, and the foil was extrusion coated with Surlyn, as in EXAMPLE 1. Finally the scores were formed and the blanks cut from the roll.

Since, in either method of constructing the carton blank, the heat seal layer 88 and the foil layer 90 are both mounted to the paperboard after formation of cuts 100A and 100B, perforations 59, and cut score 71, layers 88 and 90 form unitary and unbroken layers between the paperboard cuts and any product in the package, thus ensuring that the seal and barrier layers function as intended. It will be appreciated that, since cut score 71 does not penetrate the entire thickness of paperboard layer 94, it could be formed at any stage in construction of the laminate without serious threat to the barrier and seal layers 88 and 90, assuming quality manufacturing processes. For reasons of economy, it is normally formed with the other cuts and perforations. In the carton structure hereinafter described, cut score 71 may even penetrate additional layers without jeopardizing the performance of the finished carton.

While the barrier and seal layers are thus preserved intact, the paperboard is weakened by the cuts and cut score, such that the structure can be torn at those locations at the appropriate times. Perforations on lines 59 have another purpose, described later. In the case of EXAMPLE 2, the outside layer 96 is also cut, making the tears easier to effect at the appropriate time. Wherever layer 96 is cut in forming lines 71, and 100A and 100B, layer 96 is to be considered as part of the structural carton material. Thus, for example, when layer 96 is cut, the tear strength required to remove tab 98 is less than when layer 96 is not cut. It follows that tab 98 is also more susceptible to to damage from abuse when layer 96 is cut. Cut score 71 is similarly affected by the cutting of layer 96. The option of cutting layer 96 thus provides additional freedom in designing the remainder of the carton around the requirements of secure sealing and easy opening.

As shown in FIG. 1, the surface of the blank facing the viewer is heat seal layer 88. The first step of forming the carton from the completed carton blank is the formation of the side seam 110. For the sake of clarity, the general location of the side seam on the carton is also indicated as 110 on one side of the blank of FIG. 1. Side wall panels 22B and 12, and their respective extensions 30, 56, 39, and 64 are rotated about hinge line 24, folding the heat sealable surface 88 against itself. Edge 112 of panel 22B (and its extensions) is then folded outwardly to present the heat sealable surface 88 of the edge 112 facing upwardly. Excess material may be skived from the paperboard layer 94, if desired, plastic layer 96 also being removed, in order to facilitate seam seal formation. Panel 22A, and its respective extensions 28 and 76, are then rotated about hinge line 20 and folded over into facing relationship with the edge 112 of panel 22B. Heat is applied and the facing surfaces are sealed together forming side seam seal 110.

Figure 10:
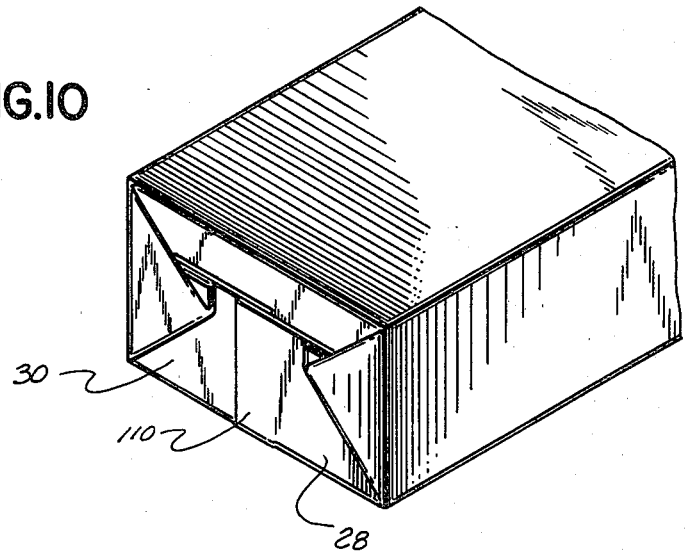
FIG. 10 is a fragmentary view taken at 10—10 of FIG. 8, and showing the bottom construction of the fully erected carton.

The carton is then erected into tubular form. Panel 48 and combined panels 28 and 30 are then rotated inwardly about hinge line 50. Simultaneously, panels 37 and 39 are folded outwardly about hinge line 50, drawing the remainder of panels 36 and 38 inwardly along with panels 48, 28 and 30. Pressing and embossing tools, not shown, are put in place, and the facing heat sealable edges are then heated and sealed together to form a modified fin seal. End panels 36 and 38 are then rotated about hinge line 50 and adhered to the exterior surfaces of panels 28 and 30. The completely finished bottom is as shown in FIG. 10. While a typical bottom formation has been disclosed, its structure is not critical and other structures are acceptable so long as the resulting structure is capable of holding liquid product.

The top of the carton is formed by making a fin seal along seal margin 84 and opening tab 98. To this end, top wall panels 58 and the combination of panels 56 and 76 are folded inwardly about hinge lines 60A, 60B, and 60C, and the respective portions of sealing margin 84 and opening tab 98, and erecting tabs 99 are brought into face-to-face relationship. Simultaneously panels 63 and 65 are rotated outwardly about their respective intermediate panels 62A and 62B, and fold about lines 67 and 69, drawing the remainder of panels 64 and 66 inwardly along with panels 76, 56, and 58. Thus panels 76, 56, 58, and portions of panels 64 and 66 adjacent hinge lines 68, 72, 80 and 82 are generally formed into a common surface as the top wall of the carton. Sealing margin 84 and opening tab 98 are then heat sealed to themselves, along a common and contiguous surface, forming an upstanding fin extending the full length of the top wall and completely sealing it. In the process of sealing margin 84 and tab 98, heat seals are preferentially made on tab 98 between the line of cut lines 100A and 100B and the outer edge of tab 98. In general, the portion of seal margin 84 between the line of cut lines 100A and 100B and hinge line 86 is not heat sealed to itself. Moreover, while minor deviations may be tolerated, it is important that these facing heat sealable surfaces remain unsealed. The seal includes tab 98 and a contiguous, continuous length of seal margin 84, and excluding that portion of margin 84 located between tab 98 and hinge line 86. Thus a continuous heat seal is effected between tab 98 and the sealed area of seal margin 84 through the general area of nicks 102A and 102B, in order to completely seal the top wall of the carton. Optionally, erecting tabs 99A and 99B may be sealed to each other at the same time. The sealed fin 114 is then folded against the top wall, and away from side seam 110. Panels 64 and 66 are then folded against end walls 12 and 14 respectively and adhered thereto, completing the construction of the package, as shown in FIG. 4.

Figure 8:
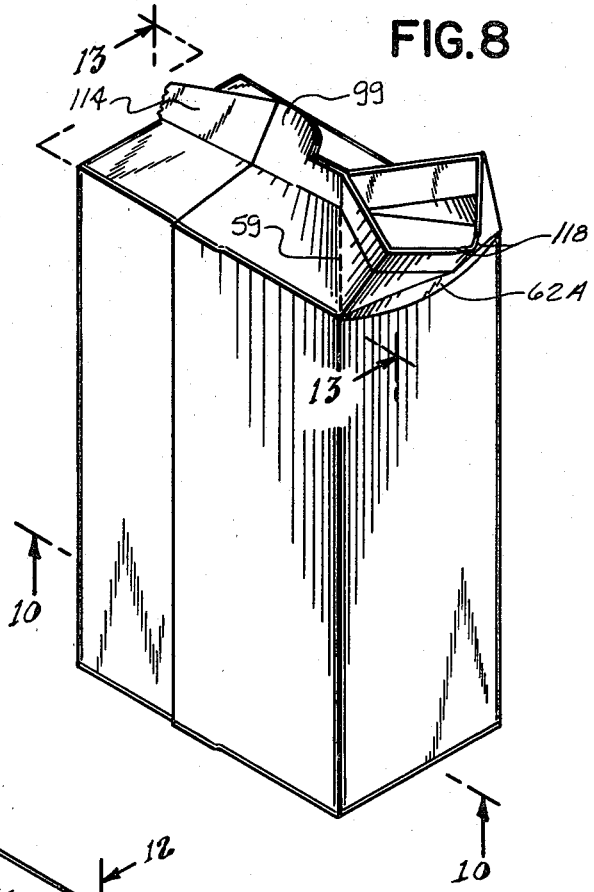
In FIG. 8 the fin is fully erected, the opening tab is removed, and the spout is open.

In opening and using the package, panel 66 is released from panel 14 as shown in FIG. 5 and opening tab 98 is raised as shown in FIG. 6. As opening tab 98 is raised, parts of fin 114 are urged erect with it, and thus parts of fin 114 have a natural tendency to be fully erected, breaking the fin by means of cut score 71, so that the fin will tend to remain erected, as shown in FIG. 8. While cut score 71 is the means of breaking fin 114, the break takes the form of a pseudo-delamination. On the side of the fin containing cut score 71, which side was folded against the top wall of the carton, the carton structural material fractures at the cut score. On the other side of the fin however, namely that extending from panels 64 and 58, the carton material fractures at that portion of hinge line 68 which extends onto the fin 114. Between the two above-recited fractures, which may typically be separated by about $\frac{1}{4}$ inch, the carton material tears through the several layers, presenting a generally fibrous surface which, in appearance, resembles a delamination.

Figure 7:
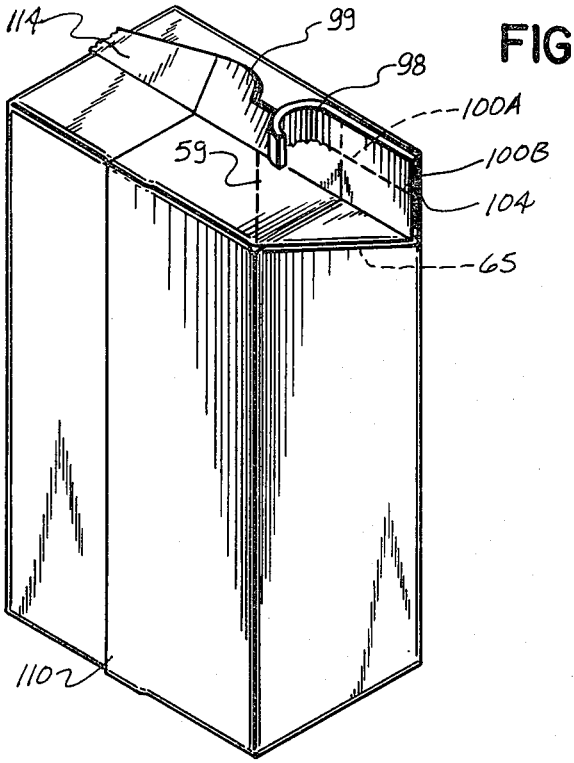
In FIG. 7 the opening tab is partially torn off.
Figure 9:
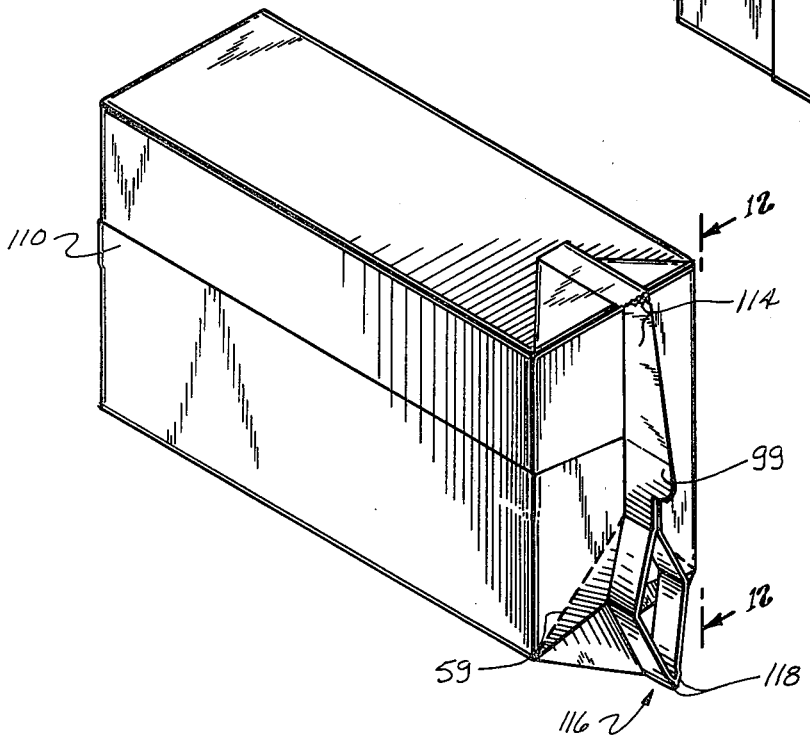
FIG. 9 shows the carton in a tipped pouring position with the spout open.

Opening tab 98 is removed from the carton by tearing it along cut lines 100A and 100B as shown in FIG. 7. Since care was taken to not heat seal together that portion of seal margin 84 underlying tab 98 the top wall is then unsealed directly below the remaining edges of cut lines 100A and 100B. Upward pressure on triangular panel 65 is normally effective to open panel 66 and adjoining portions of panels 58 and 76 into a pour spout 116 as shown in FIG. 9.

As the spout is being erected and opened, carton material is rotated greater than geometric 90° about hinge line 72A, and is reverse folded onto itself. Initially the material is folded at a 90° angle, about line 72A, with the outside layers of carton material on the inside of the angle, as in FIG. 4. When panel 66 is raised to the positions shown in FIGS. 5 and 6, the fold is straightened out and makes a relatively flat surface. In opening the spout, as in FIGS. 8 and 9, the material is rotated about line 72A to form a reverse angle having the inside layers of carton material on the inside of the angle; this reverse angle conforming generally to the angle formed about hinge line 82A, and forming one of the main corners of the opened spout 116. In some cases, the carton material around hinge line 72A resists forming the reverse angle, having the inside layers of carton material on the inside of the angle. This resistance is reliably and consistently overcome by gently lifting upwardly on erecting tabs 99 while simultaneously pushing upwardly on triangular panel 65. Thus the use of erecting tabs 99 completely obviates any propensity for the user to use a finger, or other potentially unsanitary means, to assist in opening the spout by physically touching it at hinge line 72A.

Intermediate panels 62A and 62B perform specific and desirable functions. Since both panels have similar properties, only one will be described. As best seen in German Pat. No. 2,721,390, prior art cartons use a single line hinge to join the end walls corresponding to walls 12 and 14 to the top panel. Using this configuration puts a tremendous amount of stress on the layers of carton material on the outside of the fold when, for example, panel 66 would be folded about a line hinge, which would connect panels 14 and 66, down against end panel 14 during carton closure. In such a fold, panel 65 forms a dead fold about the line hinge. The remainder of panel 66 would fold about hinge lines 72 and 82, and down over the above recited line hinge, thus forcing the carton material structure about hinge lines 72 and 82 to stretch. Further aggravating the situation is the fact that two layers of seal margin 84, namely that material surrounding hinge lines 72A and 82A, must likewise be folded over the line hinge on the outside of the fold about hinge line 72. The seal margin at line 72A folds directly against line 72, forming the second layer folded over the line hinge. The seal margin at line 82A folds over on top of the seal margin material at line 72, forming the third layer of carton material structure folded over the line hinge. While panel 65 theoretically forms a dead fold about a line hinge, each successive layer traverses a progressively longer arcuate path to negotiate a fold about the line hinge and the underlying thicknesses of carton material structure. The structural result is that each successive outer layer of carton material structure traverses a progressively longer path with an essentially non-extensible material. Functionally, excessive stress is imposed on the outer-most layer of sealing margin 84 extending from line 82A; and the material structure has a tendency to fracture. In such fracture, layer 96 (FIGS. 2 and 3) is broken completely through, and layer 94 (FIG. 3) has substantial damage. As the damage is uncontrolled, and is concentrated in an area of margin 84 which is not sealed to itself—it is inward of opening tab 98—the damage is not only unsightly, but it also portends the risk of leakage.

In the instant structure, intermediate panel 62A, rather than a line hinge, connects panels 66 and 14 to each other. The structure is herein described with the carton in an upright configuration, such as in FIGS. 4–6. As panel 66 is rotated downwardly toward panel 14, panel 62A rotates in the same general direction and attains a position generally parallel with the top wall of the carton. It will be appreciated that, while panel 62A is generally parallel to the top wall, it is specifically a curved panel which is horizontal across its width, from line 61A to line 61A', with respect to line 61A; with the middle portion of the panel, taken transverse of the carton, lower than the ends of the panel. The curved configuration of lines 61A and 61A' is critical to the functioning of panel 62A.

When panel 62A rotates as described above, it rotates downwardly about line 61A, lowering the effective "hinge line" in the center of the top wall where the multiplicity of layers of material structure must negotiate the folding. Secondly, line 61A rotates inwardly about its ends, forming a slight indentation in panel 14 at line 61A and downwardly therefrom.

As panel 66 approaches panel 14, the maximum stresses are imposed. It has been observed in this invention, that cartons having panel 62A have a greater resisting force, and thus require a greater folding force to fold down panel 66, as compared with cartons having a line hinge; and a greater tendancy to move the spout toward a naturally erected position shown in FIG. 6. This greater force is apparent only in the latter stage of folding, as panel 66 approaches panel 14. Source of this greater resisting force is unknown. However, cartons of this invention have exhibited no fracturing at line 82A.

In order to further assist in erecting the spout to the position shown in FIGS. 8 and 9, lines 59 have perforations in layer 94, and optionally in layer 96, as shown in FIG. 14. Significantly, layers 88, 90 and 92 are not perforated, thus preserving intact the barrier and seal properties of the carton.

The perforating of lines 59 weakens those lines such that they freely serve as hinging means when the spout is opened. Much of the latent bending resistance in lines 59 is thus removed, and effectively eliminated from the spout opening process. Those skilled in the art will appreciate that lines 59 can be substantially weakened without jeopardizing the carton integrity.

The combination, then of adding panel 62A, and of perforating lines 59, contributes substantially to the process of opening the carton and erecting the spout.

Figure 11:
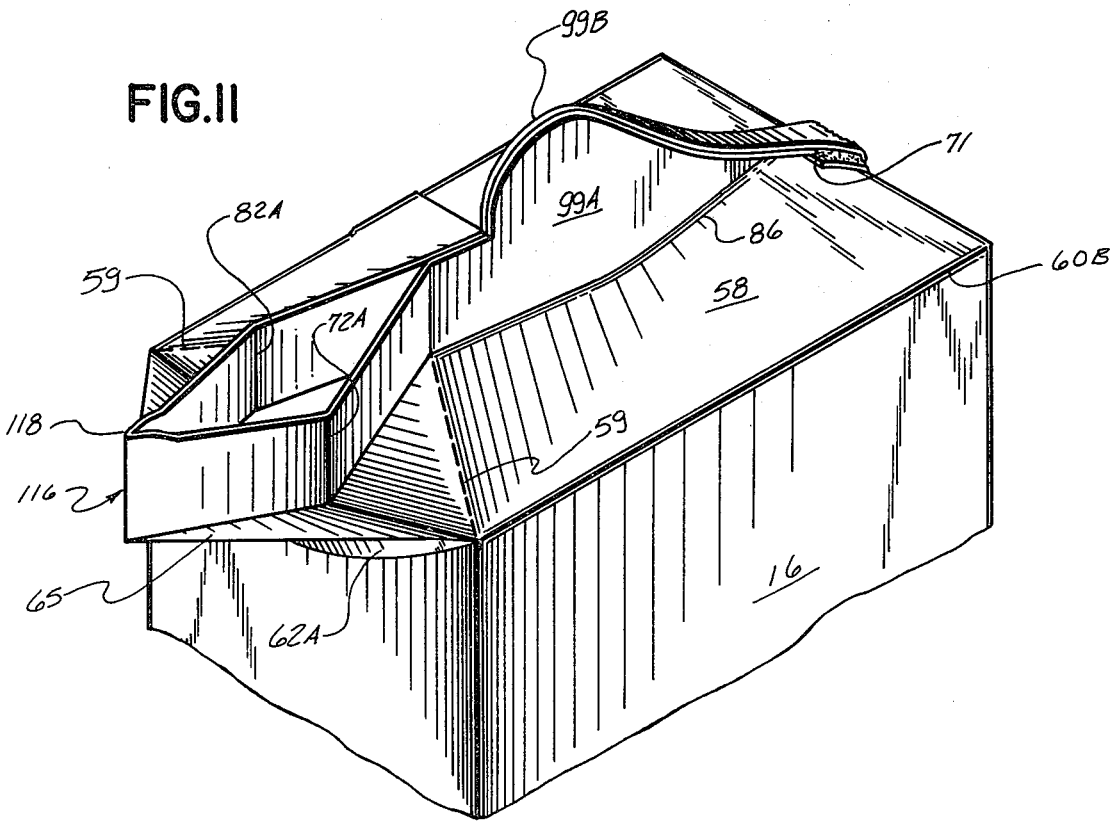
FIG. 11 is an enlarged view of the top of the opened carton.

In removing tab 98 it is significant that cut lines 100A and 100B terminate short of what will be the tip of the pour spout 116. Thus, as the tab is removed, and the tear reaches the ends of the cut lines, complete removal of the tab requires tearing of the paperboard in uncut area 104. This tearing of the paperboard leaves fibers protruding in an extended tit 118 projecting slightly above the general line of cut lines 100A and 100B, shown graphically in FIG. 11. It has been observed that, for pouring liquid slowly from a full carton, the presence of tit 118 substantially reduces the tendency of the liquid to cling to the carton and dribble down along end wall 14. While tit 118 enhances the operation of pour spout 116, and substantially improves its performance, the functioning of pour spout 116 is entirely satisfactory without tit 118 for most uses.

In an embodiment not shown, hinge line 108 is extended downwardly through panels 66 and 14, generally dividing each panel into equal sections. When the package is opened and the spout extended such as shown in FIG. 8, panels 66 and 14 rotate about the extended hinge line, increasing the effective distance of extension of the pour spout, and contributing further to the ease of pouring.

Lines 100A and 100B have been described herein as cut lines through paperboard layer 94, and, in some embodiments, also through layer 96. While cut lines are preferred, other means of weakening lines 100A and 100B are contemplated, such means as cut scores and perforations.

Thus it is seen that this invention provides a liquid-tight pouring carton which can be opened without the use of any mechanical cutting device. An opening tab is provided which can be activated to open the carton by tearing the opening tab on a predetermined and weakened line. The carton also has a complete spout which maximizes the ease of pouring. Before the carton is opened, it is fully sealed and capable of holding liquid until the opening means is activated.

The invention also provides a blank suitable for erection into the carton; and provides a method of making the blank, and subsequently forming it into the carton.

Having thus described the invention, what is claimed is:

1. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said top wall being joined to said end wall on said one end of said carton by an intermediate panel defined by a pair of arcuate score lines extending from one said side wall to another said side wall.

2. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton, said lining being devoid of said structural lines of weakness, and comprising a portion of said material structure, said structural lines of weakness comprising substantially continuous cut lines through said structural carton material, said lining being unbroken and unweakened in the area of said cut lines, said top wall being joined to said end wall on said one end of said carton by an intermediate panel defined by a pair of arcuate score lines extending from one said side wall to another said side wall.

3. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton, said lining being devoid of said structural lines of weakness, and comprising a portion of said material structure, said top wall having a pour spout on the end thereof corresponding to said one end of said carton, the combination of said pour spout and said removable section being cooperatively disposed so that, upon removal of said removable section, said spout may be opened for dispensing product, said top wall being joined to said end wall on said one end of said carton by an intermediate panel defined by a pair of arcuate score lines extending from one side wall to another said side wall.

4. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton said lining being devoid of said structural lines of weakness, and comprising a portion of said material structure, said structural lines of weakness comprising substantially continuous cut lines through said structural carton material, said lining being unbroken and unweakened in the area of said cut lines, wherein said top wall is joined to said end wall on said one end of said carton by an intermediate panel defined by a pair of arcuate score lines extending from one said side wall to another said side wall, and wherein erecting tabs are disposed on said margins between said opening tab and the other said end of said fin.

5. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin have a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material, said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton, said lining being devoid of said structural lines of weakness, and comprising a portion of said material structure, said top wall having a pour spout on the end thereof corresponding to said one end of said carton, the combination of said pour spout and said removable section being cooperatively disposed so that, upon removal of said removable section, said spout may be opened for dispensing product, wherein said top wall is joined to said end wall on said one end of said carton by an intermediate panel defined by a pair of arcuate score lines extending from one said side wall to another said side wall, and wherein erecting tabs are disposed on said margins between said opening tab and the other said end of said fin.

6. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top, said top wall being joined to said end wall on said one end of said carton by an intermediate panel defined by a pair of arcuate score lines extending from one said side wall to another said side wall; and said carton having, on said one end, lines of perforations on said extension panels extending diagonally across said panels from substantially the joinder of said side walls and the corresponding end wall to generally said point short of the other end of said fin.

7. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton, said lining being devoid of said structural lines of weakness, and comprising a portion of said material structure, said structural lines of weakness comprising substantially continuous cut lines through said structural carton material, said lining being unbroken and unweakened in the area of said cut lines, said top wall being joined to said end wall on said one end of said carton by an intermediate panel defined by a pair of arcuate score lines extending from one said side wall to another said side wall; and said carton having, on said one end, lines of perforations on said extension panels extending diagonally across said panels from substantially the joinder of said side walls and the corresponding end wall to generally said point short of the other end of said fin.

8. A liquid tight carton constructed from a structural carton material, and having a heat sealable layer on the inner surface thereof, said structural carton material and said heat sealable layer comprising the material structure of said carton, said carton commprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin have a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said carton comprising a layer of metal foil interposed between, and being adherent to, said structural carton material and said heat sealable layer, said metal foil and said heat sealable layer comprising an inner lining in said carton, said lining being devoid of said structural lines of weakness, and comprising a portion of said material structure, said top wall having a pour spout on the end thereof corresponding to said one end of said carton, the combination of said pour spout and said removable section being cooperatively disposed so that, upon removal of said removable section, said spout may be opened for dispensing product, said top wall being joined to said end wall on said one end of said carton by an intermediate panel defined by a pair of arcuate score lines extending from one side wall to another said side wall; and said carton having, on said one end, lines of perforations on said extension panels extending diagonally across said panels from substantially the joinder of said side walls and the corresponding end wall to generally said point short of the other end of said fin.

9. A carton as in claim 1, 2, 3, 4, 5, 6, 7, or 8, wherein said margins comprising said fin have an opening tab connected thereto on said one end of said fin; said structural line of weakness on each said thickness of said material structure being disposed between said opening tab and the corresponding one of said margins, said opening tab being joined together, and comprising said easily removable section of the top wall; said sealing margins disposed generally between said opening tab and the interior of said carton on said one end of said fin, and being substantially free of seals between one another; the top of said carton having a substantially continuous seal along the entire length thereof.

10. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as a effective barrier against leakage of product which may be contained in said carton; said structural lines of weakness on opposing thicknesses of said material structure being in substantial registry with one another, forming an easily removable section of the top wall, said margins comprising said fin having an opening tab connected thereto on said one end of said fin; said structural line of weakness on each said thickness of said material structure being disposed between said opening tab and the corresponding one of said margins, said opening tab being joined together, and comprising said easily removable section of the top wall; said sealing margins disposed generally between said opening tab and the interior of said carton on said one end of said fin, and being substantially free of seals between one another; the top of said carton having a substantially continuous seal along the entire length thereof, and including erecting tabs disposed on said margins between said opening tab and the other said end of said fin.

11. A carton as in claim 10, said top wall being joined to said end walls by intermediate panels, each said intermediate panel being defined by a pair of arcuate score lines extending from one said side wall to another said side wall.

12. A liquid tight carton constructed from a structural carton material, and having a heat sealable layer on the inner surface thereof, said structural carton material and said heat sealable layer comprising the material structure of said carton, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of said extension remote from said side walls and said end walls; said sealing margins being joined together in the form of a fin seal, producing a fin having multiple thicknesses of said material structure joined together on the top of said carton; said carton having one end, and said fin having a corresponding one end, for disposition of opening means thereon; said fin having an opening tab connected thereto on said one end of said fin, and having erecting tabs disposed between said opening tab and the other said end of said fin; said seal having an outer edge disposed toward the outer edge of said fin and an inner edge disposed toward the interior of said carton; said top wall being joined to said end wall on said one end of said carton by an intermediate panel defined by a pair of arcuate score lines extending from one said side wall to another said side wall; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton; said structural lines of weakness on opposing thicknesses of said material structure being in substantial registry with one another, forming an easily removable section of the top wall; and lines of perforations on said extension panels extending diagonally across said extension panels from substantially the joinder of said side walls and said end walls to generally said point short of the other end of said fin, said perforations being disposed within said structural carton material, said heat sealable layer being devoid of said perforations.

13. A cut and scored carton blank, said blank being constructed from a structural carton material having a heat sealable layer on the surface thereof which will be on the interior of the carton, said structural carton material and said heat sealable layer comprising the material structure of said carton blank, said blank being susceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton; said carton having one end, and said fin having a corresponding one end for disposition of opening means thereon; said fin having an opening tab connected thereto on said one end of said fin, and having erecting tabs disposed between said opening tab and the other said end of said fin; said seal having an outer edge disposed toward the outer edge of said fin and an inner edge disposed toward the interior of said carton; said top wall being joined to said end wall on said one end of said carton by an intermediate panel defined by a pair of arcuate score lines extending from one said side wall to another said side wall; each said thickness of said material structure having a structural line of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, and, on said one end of said carton, lines of perforations on said extension panels extending diagonally across said extension panels from substantially the joinder of said side walls and the corresponding end wall to generally said point short of the other end of said fin, said perforations being disposed within said structural carton material, said heat sealable layer being devoid of said perforations.

14. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said top wall being joined to said end wall on said one end of said carton by an intermediate panel defined by a pair of arcuate score lines extending from one said side wall to another said side wall.

15. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a stop wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material strucutre, said structural lines of weakness comprising a substantially continuous cut line through said structural carton material, said lining being unbroken in the area of said cut, said top wall being joined to said end wall on said one end of said carton by an intermediate panel defined by a pair of arcuate score lines extending from one said side wall to another said side wall.

16. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material structure, wherein said top wall has a pour spout on the end thereof corresponding to said one end of said carton, the combination of said pour spout and said removable section being cooperatively disposed so that, upon removal of said removable section, said spout may be opened for dispensing product, said top wall being joined to said end wall on said one end of said carton by an intermediate panel defined by a pair of arcuate score lines extending from one said side wall to another said side wall.

17. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material structure, said structural lines of weakness comprising a substantially continuous cut line through said structural carton materail, said lining being unbroken in the area of said cut, wherein said top wall is joined to said end wall on said one end of said carton by an intermediate panel defined by a pair of arcuate score lines extending from one said side wall to another said side wall, and wherein erecting tabs are disposed on said margins between said opening tab and the other said end of said fin.

18. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material structure, wherein said top wall has a pour spout on the end thereof corresponding to said one end of said carton, the combination of said pour spout and said removable section being cooperatively disposed so that, upon removal of said removable section, said spout may be opened for dispensing product, wherein said top wall is joined to said end wall on said one end of said carton by an intermediate panel defined by a pair of arcuate score lines extending from one said side wall to another said side wall, and wherein erecting tabs are disposed on said margins between said opening tab and the other said end of said fin.

19. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said top wall being joined to said end wall on said one end of said carton by an intermediate panel defined by a pair of arcuate score lines extending from one said side wall to another said side wall; and said blank having, on said one end of said carton, lines of perforations on said extension panels extending diagonally across said panels from substantially the joinder of said side walls and the corresponding end wall to generally said point short of the other end of said fin.

20. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material structure, said structural lines of weakness comprising a substantially continuous cut line through said structural carton material, said lining being unbroken in the area of said cut, said top wall being joined to said end wall on said one end of said carton by an intermediate panel defined by a pair of arcuate score lines extending from one said side wall to another said side wall; and said blank having, on said one end of said carton, lines of perforations on said extension panels extending diagonally across said panels from substantially the joinder of said side walls and the corresponding end wall to generally said point short of the other end of said fin.

21. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said blank comprising a layer of metal foil interposed between, and being adhered to, said structural carton material and said heat sealable layer, said metal foil and said heat sealable layer comprising an inner lining in said erected carton, said lining being devoid of said structural lines of weakness, and comprising a portion of said material structure, wherein said top wall has a pour spout on the end thereof corresponding to said one end of said carton, the combination of said pour spout and said removable section being cooperatively disposed so that, upon removal of said removable section, said spout may be opened for dispensing product, said top wall being joined to said end wall on said one end of said carton by an intermediate panel defined by a pair of arcuate score lines extending from one said side wall to another said side wall; and said blank having, on said one end of said carton, lines of perforations on said extension panels extending diagonally across said panels from substantially the joinder of said side walls and the corresponding end wall to generally said point short of the other end of said fin.

22. A carton blank as in claims 14, 15, 16, 17, 18, 19, 20, or 21 wherein said margins comprising said fin have an opening tab connected thereto on said one end of said fin; said structural line of weakness on each said thickness of said material structure being disposed between said opening tab and the corresponding one of said margins, said opening tab being joined together, and comprising said easily removable section of said top wall; said sealing margins disposed generally between said opening tab and the interior of said carton on said one end of said fin, and being substantially free of seals between one another, the top of said carton having a substantially continuous seal along the entire length thereof.

23. A cut and scored carton blank, said blank being constructed from a structural carton material having a heat sealable layer on the surface thereof which will be on the interior of the carton, said structural carton material and said heat sealable layer comprising the material structure of said carton blank, said blank being suceptible of being erected into a carton comprising a bottom wall, upstanding side walls and upstandin end walls, said side walls and end walls connected to the edges of said bottom wall and to each other to form a receptacle; and a top wall connected to said side walls and said end walls; said top wall comprising extensions of said side walls and said end walls; said extension being joined together, and comprising main extension panels joined to said side walls and said end walls, and sealing margins on the edge of each said extension remote from said side walls and said end walls; said sealing margins being joined together in the form of a fin seal, producing a fin having multiple thicknesses of said material structure joined together on the top of said carton, said seal having an outer edge disposed toward the outer edge of said fin and an inner edge disposed toward the interior of said carton; said carton having one end, and said fin having a corresponding one end for disposition of opening means thereon; each said thickness of said material structure having a structural lines of weakness substantially on said inner edge of said seal and extending along said fin from substantially said one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of said material structure being in substantial registry with one another, forming an easily removable section of the top wall, said margins comprising said fin have an opening tab connected thereto on said one end of said fin; said structural lines of weakness on each said thickness of said material structure being disposed between said opening tab and the corresponding one of said margins, said opening tab being joined together, and comprising said easily removable section of said top wall; said sealing margins disposed generally between said opening tab and the interior of said carton on said one end of said fin, being substantially free of seals between one another, the top of said carton having a substantially continous seal along the entire length thereof and including erecting tabs disposed on said margins between said opening tab and the other said end of said fin.

24. A carton blank as in claim 23, said top wall being joined to said end walls by intermediate panels, each said intermediate panel being defined by a pair of arcuate score lines extending from one said side wall to another said side wall.

* * * * *